US008475874B2

(12) United States Patent
Vogel et al.

(10) Patent No.: US 8,475,874 B2
(45) Date of Patent: Jul. 2, 2013

(54) METHOD FOR CONTINUOUSLY OPERATING ACID OR ALKALINE ZINC OR ZINC ALLOY BATHS

(75) Inventors: Roland Vogel, Berlin (DE); Birgit Sonntag, Berlin (DE); Jens Heydecke, Berlin (DE); Jens Geisler, Berlin (DE); Ellen Habig, Berlin (DE); Andreas Noack, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 1072 days.

(21) Appl. No.: 11/722,137

(22) PCT Filed: Nov. 28, 2005

(86) PCT No.: PCT/EP2005/012689

§ 371 (c)(1),
(2), (4) Date: Jan. 31, 2009

(87) PCT Pub. No.: WO2006/066689

PCT Pub. Date: Jun. 29, 2006

(65) Prior Publication Data

US 2009/0130315 A1 May 21, 2009

(51) Int. Cl.
*C02F 1/32* (2006.01)

(52) U.S. Cl.
USPC ..... 427/343; 427/337

(58) Field of Classification Search
USPC ..... 427/343, 337
See application file for complete search history.

(56) References Cited

U.S. PATENT DOCUMENTS

| | | | | |
|---|---|---|---|---|
| 2,434,191 | A | 1/1948 | Benner et al. | |
| 2,861,927 | A | 11/1958 | Ceresa et al. | |
| 3,821,095 | A * | 6/1974 | Harbulak | 205/310 |
| 3,887,445 | A | 6/1975 | Jackson | |
| 5,246,591 | A * | 9/1993 | Abolt et al. | 210/656 |
| 5,376,256 | A | 12/1994 | Leutwyler | |
| 5,571,234 | A | 11/1996 | Leutwyler | |
| 6,391,209 | B1 | 5/2002 | Belongia et al. | |
| 6,602,394 | B1 | 8/2003 | Hillebrand | |

FOREIGN PATENT DOCUMENTS

| | | |
|---|---|---|
| DE | 3138792 | 4/1983 |
| DE | 19525509 | 1/1996 |
| DE | 19810859 | 9/1999 |
| DE | 19834353 | 2/2000 |
| EP | 0 552 128 A1 | 7/1993 |
| EP | 1369505 | 12/2003 |
| JP | 60096781 | 5/1985 |
| WO | 01/38610 | 5/2001 |

OTHER PUBLICATIONS

NPL: machine translation of EP1369505 A2, Dec. 2003.*

* cited by examiner

*Primary Examiner* — Jie Yang
(74) *Attorney, Agent, or Firm* — Renner, Otto, Boisselle & Sklar, LLP

(57) ABSTRACT

The invention provides a process for depositing metallic layers from acidic or alkaline zinc or zinc alloy baths containing organic additives selected from brighteners, surfactants and complexing agents, a soluble zinc salt and optionally further metal salts selected from Fe, Ni, Co, Sn salts, wherein the bath can be purified continuously so that the process can be operated without interruption, as well as apparatus for carrying out this process.

12 Claims, 4 Drawing Sheets

METHOD FOR CONTINUOUSLY OPERATING ACID OR ALKALINE ZINC OR ZINC ALLOY BATHS

This application is a national phase application under 35 U.S.C. 371 of International Application No. PCT/EP2005/012689, filed Nov. 28, 2005, which claims priority to DE 10 2004 061 255.2, filed Dec. 20, 2004, the contents of which are hereby incorporated by reference.

The invention relates to a process for depositing functional layers from acidic or alkaline zinc or zinc alloy baths containing organic additives selected from brighteners, surfactants and complexing agents, a soluble zinc salt and optionally further metal salts selected from Fe, Ni, Co, Sn salts, in which the bath can be purified continuously so that the process can be operated without interruption.

In order to allow the deposition of functional layers from zinc baths, organic brighteners and surfactants are added to the bath. For example, a freshly pre-pared weakly acidic zinc bath therefore contains about 10-20 g/l of organic compounds, corresponding to a Total Organic Carbon (TOC) content of about 5-10 g/l.

Losses in organic active ingredients occurring during production due to degradation processes and entrainment must be compensated for by continuous redosing. Typically, at a charge throughput of 10 kAh, 0.5 to 1.5 kg of organic compounds are added. At a charge throughput of 10 kAh, about 0.2 to 0.8 kg of organic compounds are lost by entrainment.

Due to the difference between added and entrained organic compounds, the content thereof increases during operation of the bath. A constant level of organic components should theoretically be reached at a total content corresponding to 2 to 3 times that of a freshly prepared bath. This would correspond to TOC values of about 15-25 g/l.

In practice, however, and deviating from the theoretically expected behaviour, much higher concentrations of organic compounds frequently result. This is partly due to the entrainment of impurities when the articles to be coated are insufficiently pre-treated and partly due to significant overdosing of the additives which is frequently used in order to satisfy extreme decorative requirements in the case of articles which are difficult to coat.

When the content of organic impurities increases, decorative deficiencies of the coating become more significant and result in reduced productivity. In order to reduce the decorative deficiencies, higher dosages of the organic bath additives are usually used so that the content of degradation products rises further.

The content of organic impurities can be measured in terms of the turbidity point. The turbidity point should occur at a high temperature since satisfactory coating cannot be carried out above the temperature of the turbidity point.

As a remedy, several methods are known which will be described below:

A dilution of the bath reduces the concentration of impurities in proportion to the degree of dilution. A dilution can be carried out in a simply way, but it has the disadvantage that the amount of electrolyte withdrawn from the bath must be disposed off at significant cost. In this context, the preparation of a complete fresh bath can be regarded as a special case of bath dilution.

Treatment with activated carbon by addition of and stirring with 0.5-2 g/l of activated carbon and subsequent filtration reduces the concentration of impurities by adsorption to the carbon. The disadvantage of this method is that it is labour intensive, that it achieves only a relatively small reduction of impurities and that a large proportion of the brightening bath additives is also removed.

Alkaline Zn baths contain a level of organic additives which is lower than that in acidic baths by a factor of 5 to 10. Accordingly, contamination by degradation products is usually less serious. However, in the case of alkaline alloy baths, the complexation of the alloying additive (Fe, Co, Ni, Sn) requires considerable amounts of organic complexing agents. These are degraded oxidatively at the anode and the accumulating degradation products have a negative effect on the production process.

EP 1 369 505 A2 describes a process for purifying a zinc/nickel electrolyte in a galvanic process in which a part of the process bath used in the process is evaporated until there occurs a phase separation into a lower phase, at least one middle phase and an upper phase and wherein the lower and the upper phase are separated. This process requires several steps and, due to its energy requirements, it is economically disadvantageous.

DE 198 34 353 describes a galvanic bath for depositing zinc-nickel coatings. In order to avoid the undesirable degradation of additives at the anode, it is proposed to separate the anode from the alkaline electrolyte by means of an ion exchange membrane. However, this invention has the disadvantage that the use of such membranes is costly and requires frequent maintenance.

The object of the invention is to provide a process as well as an apparatus for carrying out the process whereby the time and labour requirements for bath purification can be reduced while guaranteeing long-term good bath quality at minimal consumption of chemicals.

The invention provides a process for the deposition of functional layers from acidic or alkaline zinc or zinc alloy baths containing organic additives selected from brighteners, surfactants and complexing agents; a soluble zinc salt and optionally further metal salts selected from Fe, Ni, Co, Sn salts, which process comprises the following steps:

(i) providing a zinc or zinc alloy bath containing the aforementioned components,
(ii) depositing a zinc or zinc alloy layer on the workpiece to be coated according to processes which are known as such,
(iii) withdrawing a part of the zinc or zinc alloy bath and transferring the withdrawn part to a device for phase separation,
(iv) adding an acid or base to the withdrawn acidic or alkaline part,
(v) adjusting the temperature for acceleration of the phase separation,
(vi) separating the organic phase and, if present, the solid phases,
(vii) recycling the aqueous phase to the zinc or zinc alloy bath in such a way that the pH or hydroxide content of the zinc or zinc alloy bath remains within its operating range so that the bath can be operated without interruption, and
(viii) replenishing spent components of the zinc or zinc alloy bath.

The invention further provides an apparatus for carrying out this process comprising a container (1) for containing the zinc or zinc alloy bath, a mixing device (2) connected thereto, which is connected to a further dosing device (7) containing an acidic or alkaline solution or an alkaline solid, at least separation device (3) and (3') for receiving the withdrawn part of the zinc or zinc alloy bath, optionally a device (6) for receiving the aqueous phase from the at least one separation device (3) and (3'), a container (8) for receiving the organic phase from the separation device (3), optionally a container (8') for receiving the solid phase from the separation device (3'), and conduits required for transfer, which allow the separation of the organic and/or solid phase.

The at least one separation device (3) and (3') can have devices for stirring (4) and for temperature control (5).

DETAILED DESCRIPTION

Figure 1:
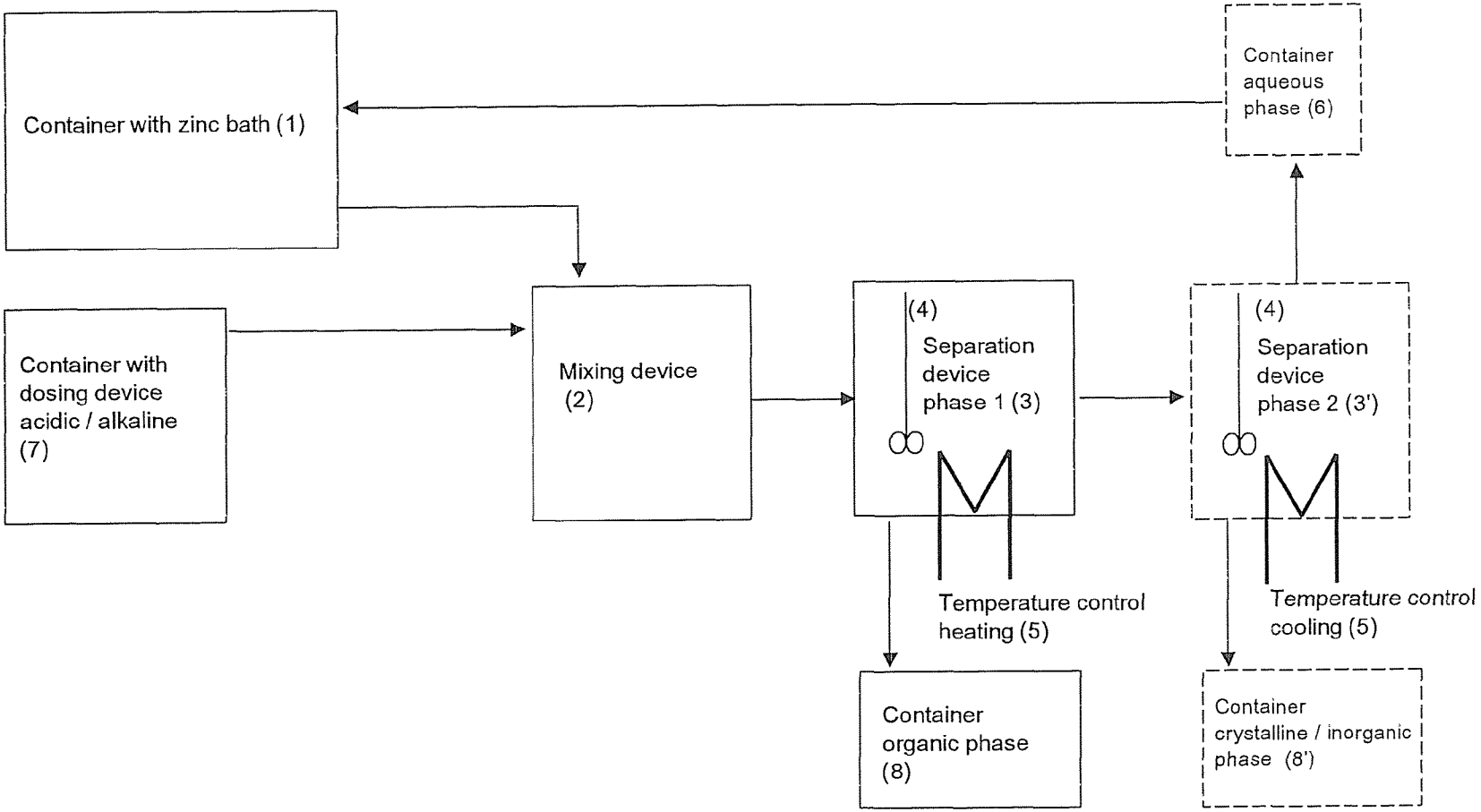
FIG. 1 is a schematic illustration of an apparatus according to an embodiment of the present invention.

FIG. 1 schematically shows an embodiment of the apparatus according to the present invention. Therein is:

(1) a container containing the zinc or zinc alloy bath,
(2) a mixing device,
(3) and (3') a separation device for receiving the withdrawn part of the zinc or zinc alloy bath,
(4) devices for stirring,
(5) devices for temperature control,
(6) a device for receiving the aqueous phase from the separation device (3) and (3'),
(7) a dosing device containing an acidic or alkaline solution or an alkaline solid,
(8) and (8') container for receiving the organic phase from the separation device (3) and receiving the solid phase from the separation device (3').

The order in which the organic and the solid phase are separated can be selected freely. It is preferably first to separate the organic phase and then to separate the solid phase.

The mixing device (2) and the separation device (3) need not be spacially separated. It is possible first to mix the solution from the zinc or zinc alloy bath (1) and the solution from the dosing device containing an acidic or alkaline solution or a basic solid (7) and then to carry out the separation of the phases in the same container.

Furthermore, the separation of the organic phase in device (3) and of the inorganic phase in device (3') can also be carried out in a single unit. In this case, it is necessary to use the device for temperature control (5) to heat for separating the organic phase and to cool for separating the solid phase. In this case it is possible to first separate either the organic phase or the solid phase.

The combination of both separation steps for the organic and the solid phase is also possible in the case of the preferred embodiments of the apparatus according to the present invention described below, although this possibility will not be expressly mentioned.

When acidic zinc or zinc alloy baths are used, it is usually sufficient to use a separation device (3) since only the separation of an organic phase will be required.

When alkaline zinc or zinc alloy baths are used, it may be useful to use a further separation unit 3'. This serves to separate the solid phase. This is preferably achieved by cooling the solution whereby the solubility of the components is reduced to such an extent that these crystallise out and may be separated.

Typical compounds which can be separated from zinc and zinc alloy baths in this way comprise carbonates, oxalates, sulphates and cyanides. In particular, the separation of toxic cyanides, which form by anodic degradation of nitrogen containing compounds, for example, from the complexing agents, is a desirable positive effect of the process according to the present invention.

A preferred embodiment of the invention comprises a container (1) for containing the zinc or zinc alloy bath, a mixing device (2) which is connected thereto via a pump and which is connected to a dosing device (7) containing an acidic or alkaline solution or an alkaline solid via a pump or chute (9), at least one separation device (3) and (3') for receiving the withdrawn part of the zinc or zinc alloy bath, optionally a device (6) for receiving the aqueous phase from the separation device (3) or (3'), a container (8) for receiving the organic phase from the separation device (3), optionally a container (8') for receiving the solid phase from the separation device (3') and conduits and valves required for transfer.

The at least one separation device (3) and (3') as well as the mixing device (2) can comprise devices for stirring (4) and for temperature control (5).

Figure 2:
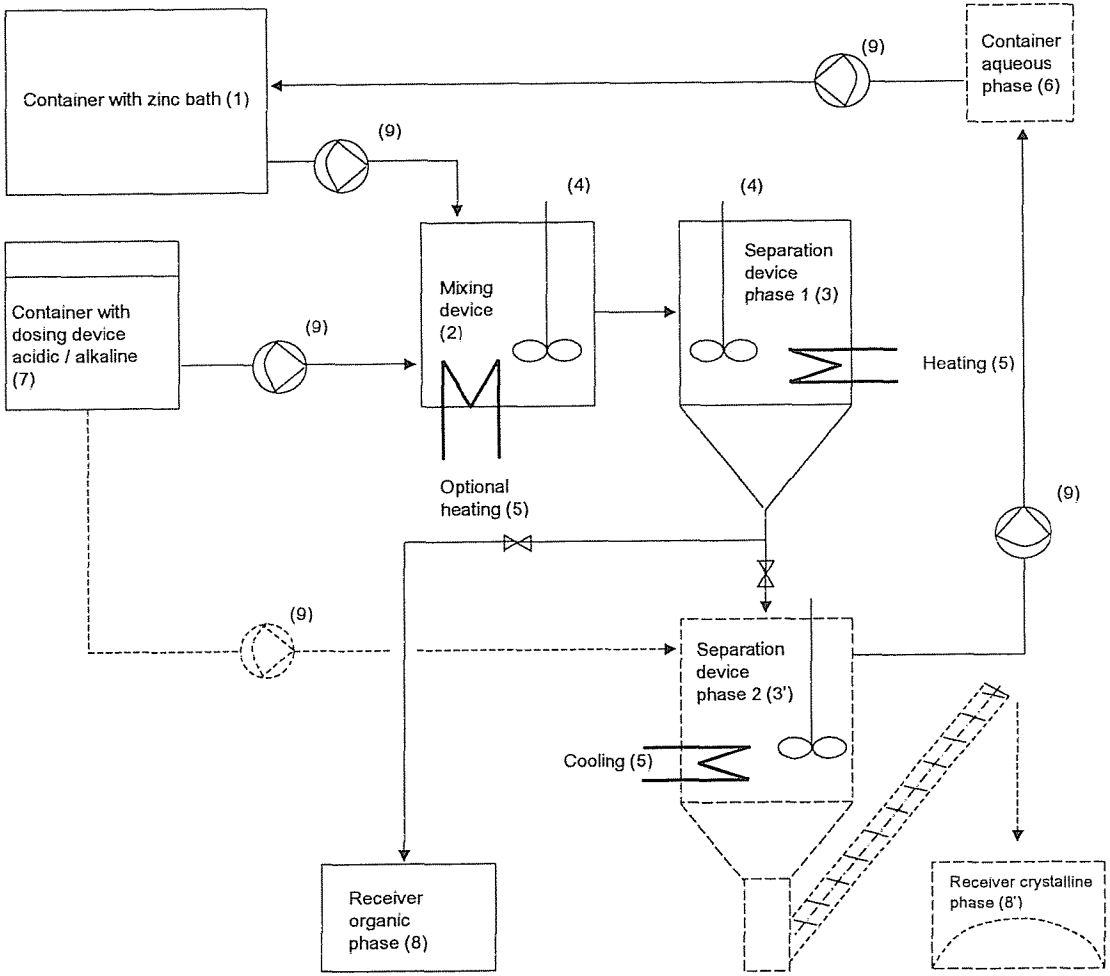
FIG. 2 is a schematic illustration of an apparatus according to another embodiment of the present invention.

FIG. 2 schematically shows an embodiment of the apparatus according to the present invention. Therein is:

(1) a container containing the zinc or zinc alloy bath,
(2) a mixing device,
(3) and (3') a separation device for receiving the withdrawn part of the zinc or zinc alloy bath,
(4) devices for stirring,
(5) devices for temperature control,
(6) a device for receiving the aqueous phase from the at least one separation device (3) or (3'),
(7) a dosing device containing an acidic or alkaline solution or an alkaline solid,
(8) and (8') container for receiving the organic phase from the separation device (3) and receiving the solid phase from the separation device (3'),
(9) a pump or chute.

The separation of the organic and the solid phase can be carried out in the separation device (3) and (3') either simultaneously or in two subsequent steps.

The solid phase can preferably be separated by means of a crystalliser. Such systems for separating crystalline impurities from galvanic baths are known in the state of the art and are described, for example, in U.S. Pat. No. 5,376,256. Such a system is commercially available from USFilter under the designation CARBO-LUX.

According to a particularly preferred embodiment for purifying zinc or zinc alloy baths, the separation of organic and aqueous phases is carried out by means of gravity. In this case, the apparatus comprises a container (1) for containing a zinc or zinc alloy bath, a mixing device (2) connected thereto via a pump (9), a separation device (3) connected to the mixing device (2) for receiving the withdrawn part of the zinc or zinc alloy bath having a lower part for separating the aqueous phase (3*a*) and a narrower upper part for separating the organic phase (3*b*) and provided with an upper outlet for the organic phase (3*c*) and a lower outlet for the purified aqueous phase (3*d*), optionally a further separation device (3') for separating the solid phase as well as a dosing device (7) containing an acidic or alkaline solution or an alkaline solid which is connected to the mixing device (2) via a pump or chute (9), optionally a device (6) for receiving the aqueous phase from the separation device (3) or (3') and at least one container (8) and (8') for receiving the organic or solid phase from the separation device (3) and (3').

The at least one separation device (3) and (3') as well as the mixing device (2) can comprise devices for stirring (4) and for temperature control (5).

Figure 3:
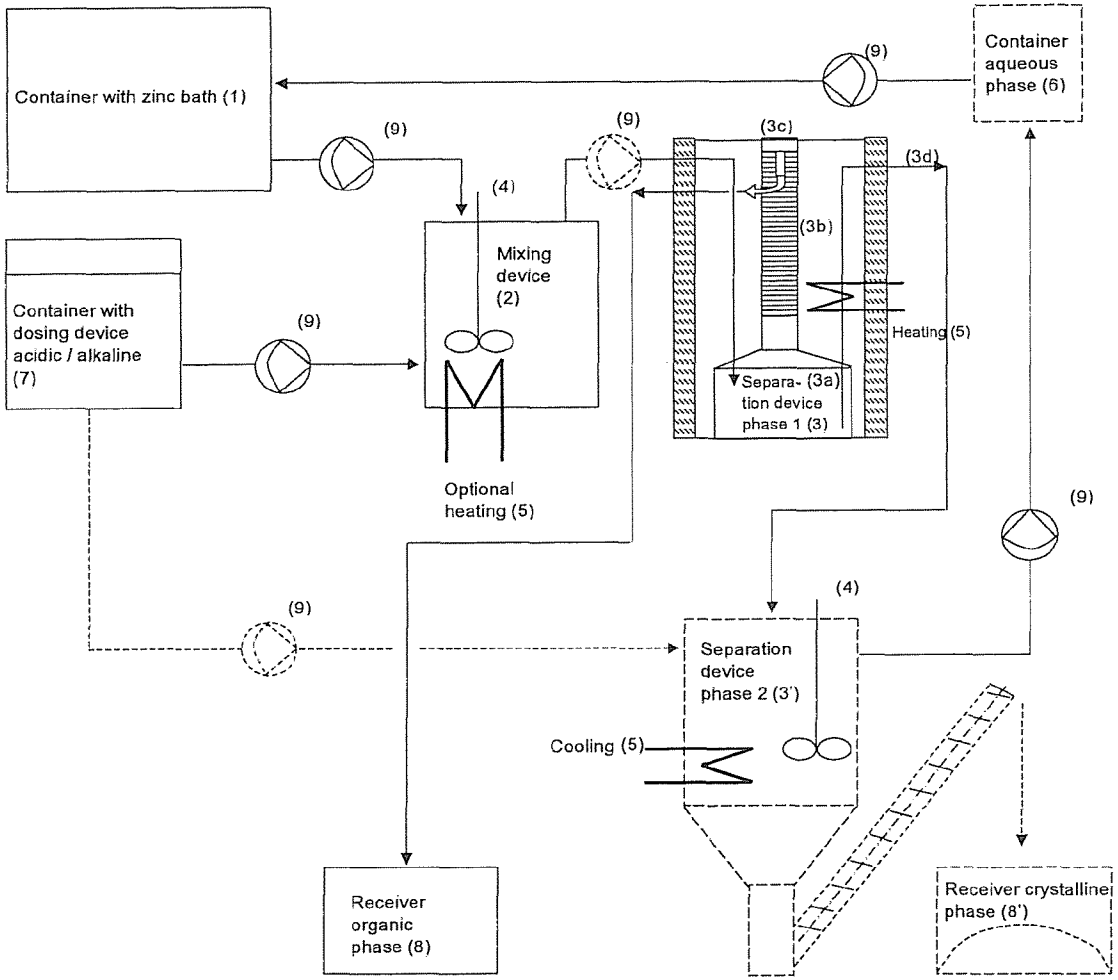
FIG. 3 is a schematic illustration of an apparatus according to yet another embodiment of the present invention.

FIG. 3 schematically shows an embodiment of the apparatus according to the present invention. Therein is:

(1) a container containing the zinc or zinc alloy bath,
(2) a mixing device,
(3) and (3') a separation device for receiving the withdrawn part of the zinc or zinc alloy bath,
(4) devices for stirring,
(5) devices for temperature control,
(6) a device for receiving the aqueous phase from the at least one separation device (3) and (3'),
(7) a dosing device containing an acidic or alkaline solution or an alkaline solid,
(8) and (8') container for receiving the organic phase from the separation device (3) and receiving the solid phase from the separation device (3'),
(9) a pump or chute.

Figure 4:
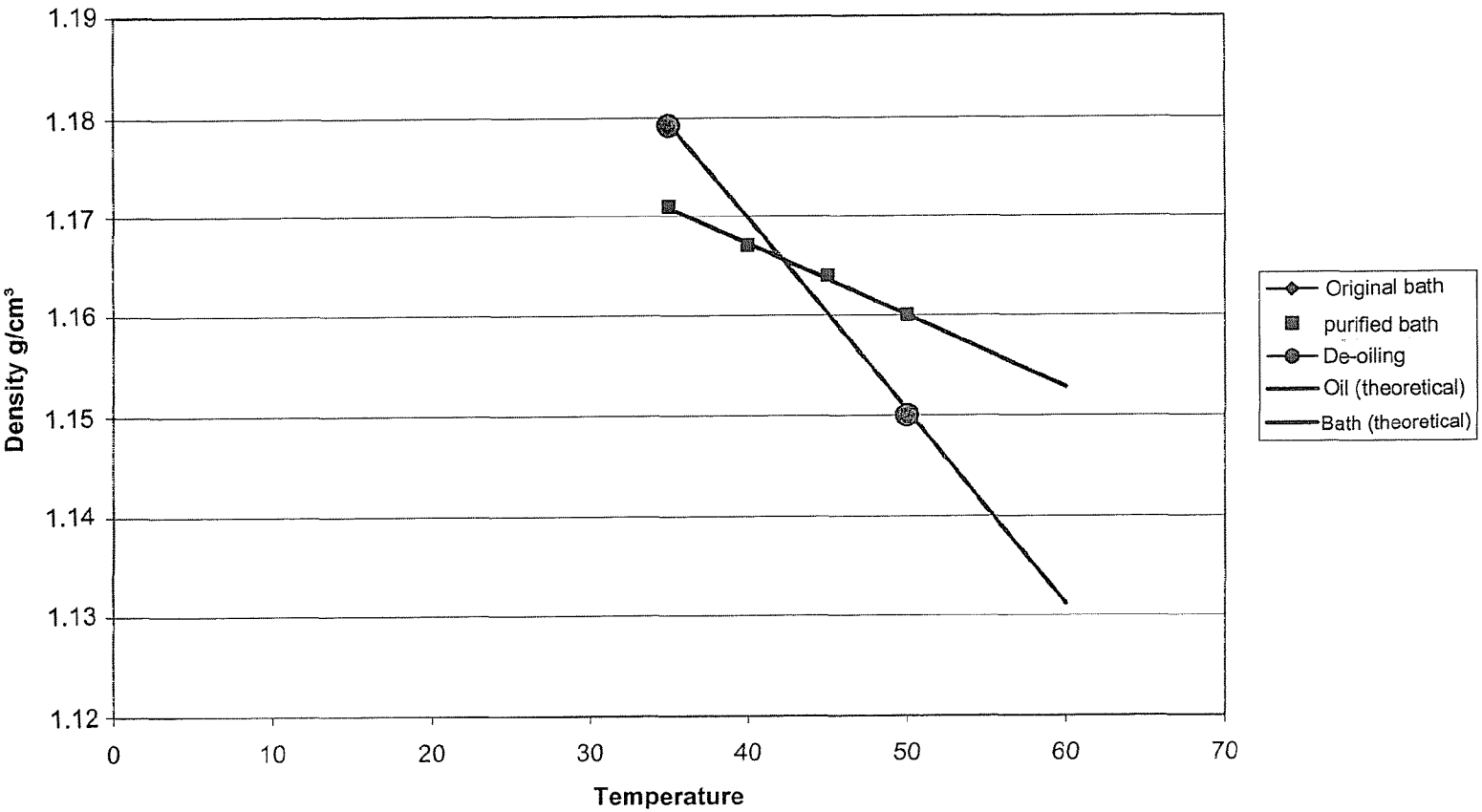
FIG. 4 is a graph of Density versus Temperature of an organic phase and an aqueous phase in accordance with an embodiment of the present invention.

The separating device (3) comprises devices for temperature control (5) which preferably consist in a mantle surrounding the separation device (3*a*) and (3*b*) and which contains, as a heat carrier, for example, water or oil and which allows the even distribution of heat within the system as well as the pre-heating of the withdrawn part the zinc or zinc alloy bath. The temperature is controlled so that the density of the organic phase is smaller than the density of the aqueous phase. FIG. 4 shows the densities of the phases as a function of temperature. This figure shows two curves which cross each other, the temperature to the right of the crossing point representing the preferred temperature range. Preferably, the temperature is chosen such that the density difference between the two phases is at least 1-1.5%. The phases flow off under gravity. In order to ensure reliable separation, the level difference of the outlet (3*d*-3*c*) is set to more than 5 mm, preferably 0.8 to 1.5 cm at a total height of device (3*a*)/(3*b*) of 1.5-2.5 m.

FIG. 3 schematically shows an embodiment of the apparatus according to the present invention. Therein is:

(1) a container containing the zinc or zinc alloy bath,
(2) a mixing device,
(3) and (3') a separation device for receiving the withdrawn part of the zinc or zinc alloy bath,
(3*a*) a lower part of the separation device,
(3*b*) an upper part of the separation device,
(3*c*) an upper outlet for the organic phase,
(3*d*) a lower outlet for the purified aqueous phase,
(4) devices for stirring,
(5) devices for temperature control,
(6) a device for receiving the aqueous phase from the at least one separation device (3) and (3'),
(7) a dosing device containing an acidic or alkaline solution or an alkaline solid,
(8) and (8') container for receiving the organic phase from the separation device (3) and receiving the solid phase from the separation device (3'),
(9) a pump/chute.

In principle, the same apparatus can be used for separating the oil phase when purifying alkaline zinc or zinc alloy baths.

In this case, the solid components crystallise at the bottom of the separation container for receiving the withdrawn parts of the zinc or zinc alloy bath (3) and can be separated there by suitable means as described above.

The process according to the present invention will be described in more detail below:

Acidic zinc baths or zinc alloy baths are usually operated at a pH in the range of 4 to 6, while basic zinc baths or zinc alloy baths are operated at a hydroxide concentration of 80-250 g/l calculated as sodium hydroxide. The hydroxide concentration is specified in g/l, rather than in pH units since, at high pH values, such as those reached when the given amounts are used, the amount of hydroxide can be specified more reliably.

The process according to the present invention uses the fact that a lowering of the pH value or an increase in the hydroxide ion concentration results in a separation of phases. For example, if the pH of the bath is reduced to pH <1 by the addition of concentrated hydrochloric acid, the anionic surfactants contained in the bath are protonated so that they lose their emulsifying activity. This results in a separation of phases, i.e., in a separation of the zinc or zinc alloy bath into an aqueous phase and an organic phase, which will also be referred to as oil phase below. The organic or oil phase contains the majority of impurities. The oil phase can amount to up to 10% of the bath volume.

In alkaline zinc and zinc alloy baths, phase separation is achieved, preferably by addition of solid sodium hydroxide, a concentration of greater than 200 g/l of sodium hydroxide being advantageous.

The reference signs used below refer to FIG. 1 and the preferred embodiments of the apparatus according to the invention as shown in FIGS. 2 and 3. In practice, the oil phase either floats on the aqueous phase and can be transferred from their from the separation device (3) to the container (8), or it forms at the bottom of the separation device (3) and is then pumped from there to container (8). After removing the oil phase, the aqueous phase is transferred to the bath for adjusting the pH value of the bath to the prescribed value, bath additives lost with the oil phase are replaced and production can continue at good quality. In order to achieve a constant pH value in the bath, the aqueous phase can be stored in a container (6) and can be added to the bath as required.

Since cathodic and anodic current yields typically differ by 1-2%, weakly acidic zinc baths require the addition of 0.5 to 11 of concentrated hydrochloric acid per 10 kAh in order to keep the pH value within the operating range. This amount of acid is sufficient in order to lower 30-60 l of the bath to a pH <1. The acid is added to a partial volume of the bath, the oil phase formed is separated and the acidified bath is recycled to the main bath to control the pH thereof.

At typical throughput values of 100 kAh per day, one can thus de-oil 300-600 l of bath per day. A typical bath volume of 20,000 l can thus be purified within 30-60 days and can subsequently be kept at a stable low TOC level.

In the process according to the invention, at a total bath volume of, for example, 20,000 l, 100 to 200 l of the bath volume are pumped into the separation unit (3) and are acidified with 15-20 ml/l of hydrochloric acid (35-37%). Other acids can be used in the process according to the present invention, however, mineral acids and, in particular, hydrochloric acid are preferred. In the separation device (3), the acidified bath is preferably adjusted to a temperature of 20-70° C., more preferably 20-50° C. in order to accelerate the phase separation, the aforementioned temperature range only being preferred and not critical, i.e., the process can also be carried out at a temperature in the range of 5-90° C.

As mentioned above, the phase separation can also be effected by increasing the hydroxide ion concentration of the bath. Such a phase separation occurs, for example, when the sodium hydroxide content is raised to a level of >200 g/l.

The base required for replacement of losses due to entrainment, for example, sodium hydroxide, is provided (with regard to the aforementioned bath volume) in an amount of 1-10 kg/10 kAh in container (7). Solid sodium hydroxide from container (7) can then be dissolved in parts of the bath in mixing device (2) and pumped to separation devices (3) or (3'), where the phase separation takes place so that usually a lower solid, in most cases crystalline, phase and a partially crystalline upper phase are formed. The upper phase is subsequently separated and transferred to container (8).

Thereafter, the bath can be cooled to a temperature within the range of −5 to 30° C. and preferably 0 to 8° C. in order to remove undesirable inorganic components by crystallisation. This is preferably done in the second separation device (3'); however, both devices can be realised in a single unit. The crystalline pre-cipitate can again be separated in a container (8') and the remaining aqueous electrolyte phase can be recycled to the bath, optionally with heating.

After the phase separation, the aqueous phase is thus transferred to container (6). In order to achieve a constant hydroxide ion concentration in the bath, the aqueous phase can be stored in a container (6) and can be added to the bath as required.

The oil phase formed in the separation device (3) is removed by a corresponding conduit and is collected in a separate container (8) and is disposed off. The crystalline phase formed in separation device (3') is removed by corresponding conduits and is collected in a separate container (8') and disposed off. The separation devices (3) and (3') are provided with conduits in such a way that a phase separating at the bottom of the separation container as well as a phase floating on top of the aqueous phase can be removed. Preferably, devices for physical phase distinction are provided.

If a correction of the pH value or of the hydroxide ion concentration in the zinc or zinc alloy bath (1) is required, the treated part is pumped from the container (6) into the bath.

The process according to the present invention can be carried out automatically by controlling it by means of pH sensors, temperature sensors, level indicators and the aforementioned devices for physical phase distinction.

The control unit records, inter alia, the liquid level in the separation device (3) and (3') and automatically activates a pump as soon as the level falls below a predetermined minimum value. The pump then transfers a part of the solution from the zinc or zinc alloy bath (1) until a predetermined maximum level is reached within the separation devices. Furthermore, the control unit controls the devices for stirring (4) and for temperature control (5) optionally provided in the separation devices.

Furthermore, the control unit effects the addition of an acidic or alkaline solution or of an alkaline solid from the dosing device (7).

As soon as a predetermined temperature is reached in the device (3) or (3'), the control unit switches the stirring and temperature control devices off so that the phase separation can take place.

As described above, the regenerated phase is transferred to a device (6) which can have a capacity of, for example, 200 l (at a total bath volume of 20,000 l). The device can also be provided with level indicators and devices for level control and it is connected to bath (1). As soon as the pH value or the hydroxide ion concentration of the bath (1) lies outside the predetermined operating range, which can be detected by means of pH sensors, regenerated bath solution is transferred to the bath (1) from the device (6) to correct the pH value or the hydroxide ion concentration. While the process according to the present invention has been described above primarily with reference to the use of an acid for phase separation, it can also be carried out, as described above, by using bases, preferably alkali or alkaline earth metal hydroxides and, in particular, sodium hydroxide.

It is an essential advantage of the process according to the present invention that the production process need not be interrupted for purifying or replacing the bath. Impurities can be removed continuously or discontinuously and necessary bath components can be replenished.

Thus, compared to processes known in the state of the art, the process according to the present invention is considerably simpler and more cost-efficient to run. In particular, it is an advantage compared to known processes that a phase separation is achieved by addition of an acid or a base, which have to be added to the zinc or zinc alloy bath in any event to control the process.

The following examples serve to illustrate the purification or regeneration process according to the present invention:

DETAILED DESCRIPTION

EXAMPLE 1

A sample of a weakly acidic zinc bath with a TOC content of 30.2 g/l and 2.6 ml/l brightening additives as well as 35.8 ml/additive solution was acidified with 20 ml/l of hydrochloric acid (37%) to a pH of <1. For this purpose, an apparatus according to FIG. 2 comprising a separation unit (3) and a container (6) for receiving the aqueous phase from the separation container (3) was used. A slow separation of two phases was observed. Within 24 hours, 25 ml/l of a dark brown viscous phase separated at the bottom of the container. The clear supernatant solution was analysed to contain 21.5 g/l TOC, 1.5 ml/l brightening additive and 26.4 ml/l additive solution. After adjusting the pH to a value within the operating range (pH 5), a Hull cell test showed mainly bright surface, however, with burns in the high current density area. After adjusting to the predetermined values by addition of 0.5 ml/l of brightening additive and 4 ml/l additive solution, a highly bright surface across the entire current density range was obtained. The turbidity point of the bath before the treatment was 50° C., after the treatment and adjustment, it was 75° C.

EXAMPLE 2

A sample of a bath with a TOC content of 30.2 g/l and 2.6 ml/l brightening additive as well as 35.8 ml/l additive solution was acidified with 20 ml/l of hydrochloric acid (37%) to pH of <1. For this purpose, an apparatus according to FIG. 3 comprising a separating unit (3) and a container (6) for receiving the aqueous phase from the separating container (3) was used. The level difference (3*c*)-(3*d*) was 15 mm, while the total height of the device (3*a*)+(3*b*) was 2 m. The sample was heated to 50° C. Within 2 hours, 55 ml/l of a dark brown oil phase separated above the aqueous phase. The clear aqueous phase was analysed to contain 13.1 g/l TOC, 0.6 ml/l of brightening additive and 21.8 ml/l additive solution. After adjusting the pH to a value within the operating range (pH 5), a Hull cell test showed an evenly bright surface with slight haze in the area of low current density. After adjustment to the predetermined values by addition of 1.4 ml of brightening additive and 8 ml/l additive solution, a highly bright surface was obtained across the entire current density range. The turbidity point of the bath before the treatment was 50° C., after the treatment and adjustment it was 85° C.

It can be estimated from the analytical values that the separated oil phase consisted of 10-15% of functional bath additives and 85-90% impurities.

EXAMPLE 3

In this example, an apparatus according to FIG. 3 with two separation units (3) and (3') and a container (6) for receiving the aqueous phase from the separation devices (3) and (3') was used. The separation unit (3') comprised a crystalliser from Carbolux.

In a sample of an alkaline zinc-nickel production bath (after a throughput of about 2,000 Ah/l), 90 g/l of NaOH were dissolved. About 50 ml/l of a viscous, partially crystalline mass separated at the top of the bath. At the bottom of the container, there formed about 10 g/l of a crystalline precipitation. The electrolyte phase was separated from the solid phases and analysed in comparison to the initial bath.

| Analytical values | Initial bath | Treated bath | Difference |
|---|---|---|---|
| NaOH [g/l] | 127.0 | 214.0 | +68% |
| $Na_2CO_3$ [g/l] | 54.3 | 35.4 | −35% |
| $Na_2SO_4$ [g/l] | 35.2 | 30.3 | −14% |
| TOC [g/l] | 48.8 | 34.6 | −29% |

The invention claimed is:

1. A process for the deposition of functional layers from acidic or alkaline zinc or zinc alloy baths containing organic additives selected from brighteners, surfactants and complexing agents; a soluble zinc salt and optionally further metal salts selected from Fe, Ni, Co, Sn salts, which process comprises the following steps:

(i) providing a zinc or zinc alloy bath containing the aforementioned components, (ii) depositing a zinc or zinc alloy layer on the workpiece to be coated according to processes which are known as such, (iii) withdrawing a part of the zinc or zinc alloy bath and transferring the withdrawn part to a device for phase separation, (iv) adding an acid or base to the withdrawn acidic or alkaline part, wherein, when adding acid to the withdrawn acidic part, sufficient acid is added to reduce the pH of the withdrawn acidic part to a pH <1, (v) adjusting the temperature for acceleration of the phase separation, (vi) separating the organic phase and, if present, the solid phases, (vii) recycling the aqueous phase to the zinc or zinc alloy bath in such a way that the pH or hydroxide content of the zinc or zinc alloy bath remains within its operating range so that the bath can be operated without interruption, and (viii) replenishing spent components of the zinc or zinc alloy bath.

2. Process according to claim 1 wherein the withdrawal of the part of the zinc bath and the recycling are carried out continuously or discontinuously.

3. Process according to claim 1 wherein the addition of the acid and the phase separation are carried out at a temperature within the range of 5-90° C.

4. Process according to claim 1 wherein the addition of the base and the phase separation are carried out at a temperature within the range of −5-30° C. and, after separation of the organic phase, the bath is cooled to a temperature within the range of −5-20° C. in order to obtain a solid inorganic phase which is separated before recycling the aqueous phase to the zinc or zinc alloy bath.

5. Process according to claim 4 wherein the addition of the base and the phase separation are carried out at a temperature within the range of 0-8° C.

6. Process according to claim 4 wherein, after separation of the organic phase, the bath is cooled to a temperature within the range of 0-8° C.

7. Process according to claim 1 wherein the acid used is a mineral acid, and the base used is an alkali or alkaline earth hydroxide.

8. Process according to claim 7 wherein the mineral acid is hydrochloric acid and the alkali or alkaline earth hydroxide is sodium hydroxide.

9. Process according to claim 1 wherein the regeneration rate is 0.1-20% of the bath volume per day.

10. Process according to claim 1 wherein the recycling of the aqueous phase is carried out in such a way that the pH or the hydroxide ion concentration of the zinc or zinc alloy bath remains constant.

11. Process according to claim 1 wherein the formation of the organic phase in the container is detected by a sensor, the sensor initiating the removal of the organic phase from the container.

12. Process according to claim 1 wherein the addition of the acid and the phase separation are carried out at a temperature within the range of 20-50° C.

* * * * *

UNITED STATES PATENT AND TRADEMARK OFFICE

CERTIFICATE OF CORRECTION

PATENT NO. : 8,475,874 B2
APPLICATION NO. : 11/722137
DATED : July 2, 2013
INVENTOR(S) : Vogel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1735 days.

Signed and Sealed this
Eighth Day of September, 2015

Michelle K. Lee

Michelle K. Lee
*Director of the United States Patent and Trademark Office*